US007682667B2

(12) United States Patent
Imaizumi et al.

(10) Patent No.: US 7,682,667 B2
(45) Date of Patent: Mar. 23, 2010

(54) METHOD OF THERMAL SPRAYING

(75) Inventors: Yukio Imaizumi, Fukuoka (JP); Hiroki Kamakura, Fukuoka (JP); Toshio Sakurada, Fukuoka (JP); Kenichi Yamada, Fukuoka (JP); Katsuhiko Ishibashi, Fukuoka (JP)

(73) Assignees: Nishinippon Plant Engineering and Construction Co., Ltd., Fukuoka (JP); Yamada Corrosion Protection Co., Ltd., Fukuoka (JP); Kyushu Electric Power Co., Inc., Fukuoka (JP)

( * ) Notice: Subject to any disclaimer, the term of this patent is extended or adjusted under 35 U.S.C. 154(b) by 298 days.

(21) Appl. No.: 10/574,691

(22) PCT Filed: Oct. 15, 2004

(86) PCT No.: PCT/JP2004/015257

§ 371 (c)(1),
(2), (4) Date: Apr. 5, 2006

(87) PCT Pub. No.: WO2005/040446

PCT Pub. Date: May 6, 2005

(65) Prior Publication Data

US 2007/0054062 A1 Mar. 8, 2007

(30) Foreign Application Priority Data

Oct. 22, 2003 (JP) ..... 2003-362212

(51) Int. Cl.

| | |
|---|---|
| ***C23C 4/02*** | (2006.01) |
| ***C23C 4/08*** | (2006.01) |
| ***C23C 4/12*** | (2006.01) |
| ***C23C 4/18*** | (2006.01) |

(52) U.S. Cl. ..... 427/449; 427/455; 427/456

(58) Field of Classification Search ..... 427/449
See application file for complete search history.

(56) References Cited

U.S. PATENT DOCUMENTS 3,052,590 A * 9/1962 Maros et al. ..... 156/289

(Continued)

FOREIGN PATENT DOCUMENTS

EP 0 519 310 12/1992

(Continued)

OTHER PUBLICATIONS

Thermal Spraying:Practice, Theory, and Application, American Welding Society, Inc., 1985, pp. 22, 53-54, 108-109.*

(Continued)

*Primary Examiner*—Katherine A Bareford
(74) *Attorney, Agent, or Firm*—Wenderoth, Lind & Ponack, L.L.P.

(57) ABSTRACT

An adhesion strength of spray coating comparable to that obtained in a conventional combination of blast treatment and gas flame spraying can be realized even if roughening is conducted with the use of simple tools by performing in advance such a roughening treatment that the average roughness (Ra) of the surface of the thermal spray subject falls within the range of 2 to 10 μm with the use of a grinding tool, and thereafter carrying out thermal spraying under such conditions that the average area of each of molten particles when molten particles of a thermal spray material have stuck to the surface of thermal spray subject falls within the range of 10000 to 100000 $\mu m^2$. In the roughening by grinding tools, a large-scale apparatus is not needed as different from the blast treatment, and portable small tools can be used in overhead location work at field repair. The scattering of powder resulting from grinding is slight so that the danger of environmental pollution is low.

10 Claims, 2 Drawing Sheets

U.S. PATENT DOCUMENTS

| | | | | |
|---|---|---|---|---|
| 4,762,977 | A * | 8/1988 | Browning | 219/121.47 |
| 4,788,077 | A * | 11/1988 | Kang | 427/456 |
| 5,123,152 | A * | 6/1992 | Tenkula et al. | 492/58 |
| 5,407,035 | A * | 4/1995 | Cole et al. | 188/218 XL |
| 5,763,015 | A | 6/1998 | Hasui et al. | |
| 7,338,699 | B2 * | 3/2008 | Takahashi et al. | 428/149 |

FOREIGN PATENT DOCUMENTS

| | | |
|---|---|---|
| EP | 0 771 885 | 5/1997 |
| JP | 54-46144 | 4/1979 |
| JP | 61-104062 | 5/1986 |
| JP | 5-80273 | 11/1993 |
| JP | 6-39682 | 5/1994 |
| JP | 2000-64063 | 2/2000 |
| JP | 2000-80956 | 3/2000 |
| JP | 2001-89880 | 4/2001 |
| JP | 3261518 | 12/2001 |
| JP | 2002-69604 | 3/2002 |
| JP | 2002-80956 | 3/2002 |
| JP | 2003-13195 | 1/2003 |
| JP | 2003-286559 | 10/2003 |
| WO | 02/40733 | 5/2002 |

OTHER PUBLICATIONS

English translation of Japan 1986-104062(61-104062), originaly published in Japanese May 22, 1986.*

* cited by examiner

METHOD OF THERMAL SPRAYING

TECHNICAL FIELD

The present invention relates to a method of thermal spraying for forming a metal spray coating for corrosion prevention on a surface of a metal body. More particularly, the present invention relates to a method of thermal spraying suitable for field repair of a steel structure.

BACKGROUND ART

Conventionally, a coating is generally used for preventing corrosion in steel structures such as a steel tower, a bridge, an elevated structure, and a tank. The coating has problems in that the coating cost is expensive, the useful life is limited, and the repair cost is also expensive because regular recoating is required. Thus, as a measure to prevent corrosion that can replace the coating, a construction method is proposed in which a spray coating is formed on a steel surface. For example, Patent Reference 1 describes an anticorrosive structure for a steel structure in which thermal spraying is performed for a portion of the steel structure that is placed in a bad environment and weather proof steel is used for other portions. It is described that this anticorrosive structure can improve an anticorrosive property of the entire steel structure and can reduce a construction cost and a repair cost.

For a marine structure that is exposed to a severe corrosive environment for a long period of time, a construction method that forms a resin lining coating is conventionally used and thermal spraying is proposed as a method for repairing a damaged portion of the lining coating on the site. For example, Patent Reference 2 describes a method for repairing a lining coating for corrosion prevention in which a base surface treatment is performed to roughen a defect portion generated in the lining coating, then the defect portion is preheated to a necessary temperature, and thereafter a repair coating is formed by performing thermal spraying of fine particles of a polymer compound to the defect portion. It is described that this repair method enables field repair with a longer life and higher reliability as compared with a conventional repair method that performs repair with a coating material that hardens at room temperature.

A spray coating is excellent in properties such as corrosive resistance, heat resistance, and wear resistance. Thus, thermal spraying is used in a broad range as a surface modification technique not only for steel that is a material for a steel structure but also for various materials and products. In thermal spraying, a spray coating is formed by spraying a thermal spray material that is heated to be in a molten state or a semi-molten state onto a thermal spray subject. Gas flame spraying and plasma spraying are known as principal methods of thermal spraying.

In gas flame spraying, a thermal spray material in the form of a line, a stick or powder is heated by using combustion flame of oxygen and combustible gas so as to be in a molten state or a state close to the molten state, and is then sprayed onto a thermal spray subject so as to form a spray coating. Gas flame spraying is most common because an operation is easy and a cost of equipment and a running cost are inexpensive.

In plasma spraying, a thermal spray material is heated and accelerated by using a plasma jet so as to be in a molten state or a state close to the molten state. Then, a spray coating is formed by spraying the thermal spray material onto a thermal spray subject. Plasma spraying can use various thermal spray materials including high melting point ceramics, metals, and plastics. In plasma spraying, thermal spraying can be performed in an air, an inert atmosphere, or a reduced-pressure atmosphere. The thermal spray material used in plasma spraying is typically in the form of powder. However, a plasma arc torch using a thermal spray material in the form of a line or a stick is proposed in Patent References 3 to 5 in recent years.

Patent Reference 1: Unexamined Japanese Patent Publication No. 2001-89880

Patent Reference 2: Unexamined Japanese Patent Publication No. 2002-69604

Patent Reference 3: Japanese Patent Publication No. 5-80273

Patent Reference 4: Japanese Patent Publication No. 6-39682

Patent Reference 5: Japanese Patent No. 3261518

SUMMARY OF THE INVENTION

Before thermal spraying, it is necessary to remove a coating, a plating film, oxide, or the like on a surface of a thermal spray subject and roughen the surface as a pretreatment for the thermal spray subject. Roughening of the surface of the thermal spray subject provides a so-called anchor effect so that sprayed particles mechanically engage with concavities and convexities of the roughened surface and adhesion between the spray coating and the thermal spray subject is enhanced. The roughening is usually performed by a method called a blast treatment. There are some techniques of blast treatment. In a typical technique, natural mineral, artificial mineral, metal grit, nonmetal grit, cut wire, or the like is projected onto the thermal spray subject by using a compressed air, thereby exposing a base material of the subject and forming minute irregular concavities and convexities on the surface of the subject.

The blast treatment requires a large-scale apparatus, e.g., a hopper for a blast material, a tank, an air compression apparatus, a compressed air piping, a blast material supply piping, a torch, a blast material recovery apparatus, and a dust collecting apparatus. In the case of a construction process in which those apparatuses are installed in a plant for processing a material for a steel structure or the like, the blast treatment is performed in a material processing step, and thereafter the material for which thermal spraying has been performed is carried to a construction site and the steel structure is constructed there, the blast treatment can be performed without a significant problem. However, in the case of field repair, there are serious problems when a cost, work, and an environment are considered. Thus, there is great difficulty in performing the blast treatment. It is difficult to install all the above apparatuses on a repair site in order to perform the blast treatment on the repair site. Moreover, field repair of a large structure is performed by overhead location work in many cases and it is difficult to install the necessary apparatuses at an overhead location. Furthermore, it is difficult to recover the blast material during the blast treatment and collect dust generated in the blast treatment. Thus, the blast material and dust that are scattered deteriorate a working condition and pollute an environment.

As described above, the blast treatment cannot be performed actually in the case of field repair using thermal spraying. Thus, it is necessary to take a roughening method that replaces the blast treatment. Moreover, even if the blast treatment is performed in the plant for processing the material, it is not possible to avoid deterioration of the working condition. Therefore, it is better to apply the roughening method that replaces the blast treatment.

It is therefore a problem to be solved by the present invention to find out, in the case where a metal thermal spray material is sprayed onto a metal body to form a spray coating for corrosion prevention, a condition for roughening a thermal spray subject and a condition of thermal spraying that provide practically sufficient adhesion strength between the spray coating and the thermal spray subject, and to improve workability of a roughening process and reduce a spraying cost while maintaining an anticorrosive effect.

The inventors earnestly studied an effect of the condition for roughening of the thermal spray subject as a pretreatment of thermal spraying and the condition of thermal spraying on the adhesion strength between the spray coating and the thermal spray subject, and completed the present invention by finding that the practically sufficient adhesion strength of the spray coating could be obtained by performing thermal spraying under a particular condition even in the case where the thermal spray subject was roughened with a relatively simple tool.

A thermal spraying method according to the present invention is a method that sprays a metal thermal spray material to a metal body especially by plasma spraying to form a spray coating for corrosion prevention. The thermal spraying method includes: roughening a surface of a thermal spray subject by using a grinding tool to achieve an average roughness Ra of the surface in a range of from 2 to 10 μm; and performing thermal spraying under a condition in which an average area of each of molten particles of the thermal spray material when the molten particles have stuck to the surface of the thermal spray subject is 10000 to 100000 $\mu m^2$.

It is preferable to use a thermal spraying apparatus that uses the metal thermal spray material in the form of a line or a stick as a plasma spraying apparatus. It is also preferable to use an aluminum alloy, more preferably, an aluminum-magnesium alloy, as the metal thermal spray material. Moreover, the thermal spraying method may further include performing a sealing treatment in the coating after the thermal spraying.

When plasma spraying is performed under the condition in which the average area of each molten particle when the molten particles have stuck to the surface of the thermal spraying subject falls within a predetermined range, a temperature of the surface of the thermal spraying subject increases and wettability of a droplet with respect to the surface of the thermal spraying subject is improved. Thus, even if roughening is performed by the grinding tool that provides a lower level of roughness than the blast treatment, the adhesion strength of the spray coating that is considerable to that obtained by a combination of the blast treatment and gas flame spraying can be obtained. In the roughening by means of the grinding tool, a large-scale apparatus is not needed as different from the blast treatment, a portable small tool can be used in overhead location work at field repair, and scattering powder resulting from the roughening is slight so that a danger of environmental pollution is low. Furthermore, if thermal spraying can be performed under the condition in which the average area of each molten particle is 10000 to 100000 $\mu m^2$ by using arc spraying in place of plasma spraying, the same operations and advantages as those described above can be obtained.

DESCRIPTION OF REFERENCE NUMERALS

Figure 1A:
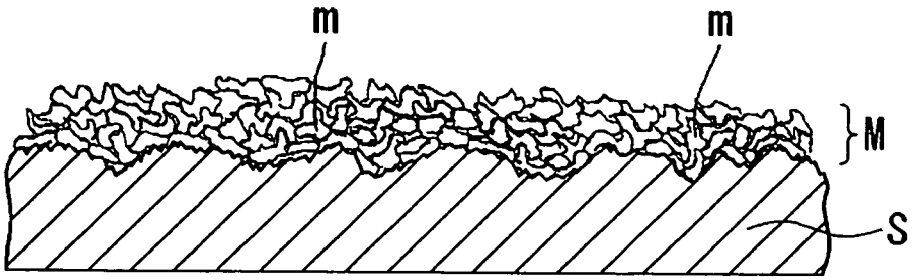
FIG. 1A generally shows a deposition state of a spray coating in the case where thermal spraying is performed by a plasma spraying apparatus.

| | |
|---|---|
| 1: | Grinding tool |
| 2: | Roller |
| 3: | Sandpaper |
| 4: | Steel |
| 5: | Spray coating |
| 6: | Plasma spraying apparatus |
| 7: | Plasma torch |
| 8: | Electrode |
| 9: | Nozzle |
| 10: | Rear wall |
| 11: | Peripheral wall |
| 12: | Tapered tube portion |
| 13: | Inflow port |
| 14: | Wire |
| 15: | Supply device |
| 16: | Guide member |
| 17: | Pushing roller |
| 18: | DC power supply device |
| 19: | Outer circumferential nozzle |
| 20: | Outlet |
| 21: | Molten particle |

DETAILED DESCRIPTION OF THE INVENTION

In the present invention, a subject of thermal spraying is a metal body. Although thermal spraying can be applied to a nonmetal body, the present invention premises plasma spraying, aims to enhance an anticorrosive function of a metal structure and reduce a repair cost, and employs a method of thermal spraying that forms a metal spray coating on the metal structure or a member for the metal structure.

In the present invention, roughening as a pretreatment of thermal spraying is performed by using a grinding tool. The grinding tool described here means an electric tool in which an abrasive grain is firmly fixed to a disc-like or belt-like base member, an electric tool in which a flap or wire is planted on an outer circumferential surface of a wheel, and the like. Some of those tools are small enough to be used in a handheld state and therefore can be suitably used especially in field repair. When a surface of the thermal spray subject is ground by means of the aforementioned grinding tool, a number of linear marks that are parallel to each other are formed on the surface. When the grinding tool is moved in a constant direction, the linear marks extend in that direction. When the moving directions of the grinding tool are crossed, the linear marks are also crossed. It is preferable to cross the moving directions of the grinding tool in order to form a number of concavities and convexities that are similar to those formed by a blast treatment. However, the roughening of the present invention can provide sufficient adhesion strength by the linear marks extending in a constant direction. In the case where the linear marks are crossed, an angle of intersection can be set to any angle. However, it is preferable to set the angle of intersection in the range of from 60 to 90 degrees.

For a most appropriate range of surface roughness obtained by the above roughening, it is desirable that average roughness Ra be in the range of from 2 to 10 μm. It is more desirable that the average roughness Ra be in the range of from 5 to 8 μm. Moreover, it is preferable that maximum roughness Rz be in the range of from 20 to 100 μm and a peak count value of roughness RPc be in the range of from 30 to 100. When the surface roughness falls within the above range, molten particles that collide against the roughened surface spread on the roughened surface with no space during thermal spraying, thus enhancing an anchor effect that the particles engage with the roughened surface.

If the average roughness Ra of the surface roughness is smaller than 2 μm, a sufficient anchor effect is not obtained and therefore the adhesion strength of the spray coating is low. Moreover, the average roughness Ra larger than 10 μm is preferable from a viewpoint of the adhesion strength of the spray coating. However, it is necessary to make a grain diameter of an abrasive grain used in the grinding tool larger in order to achieve such a rough surface, thus increasing grinding resistance and a burden on a worker who operates the grinding tool. Therefore, such large average roughness is not practical. In addition, in the case where the surface roughness is extremely large, molten metal cannot become flat enough to spread on the roughened surface. Therefore, a gap is formed between the roughened surface and the molten particles, thus lowering the adhesion strength of the spray coating.

If the maximum roughness Rz is smaller than 20 μm, it is necessary to make the surface roughness homogenous in order to obtain appropriate average roughness. Therefore, it is difficult to perform roughening by using the aforementioned grinding tool. If the maximum roughness Rz is larger than 100 μm, a grinding tool having a large-diameter grinding grain is required. However, the large-diameter grinding grain is easily consumed. Therefore, it is difficult to perform homogenous grinding and workability is lowered. If the peak count value of roughness RPc is less than 30, the number of concavities and convexities is small. That is, there are a number of small smooth portions. Therefore, the adhesion strength of the molten particles is lowered. Moreover, if the peak count value of roughness RPc is more than 100, intervals between the concavities and the convexities are too small. Thus, the molten particles do not sufficiently conform to the surface without space. That is, a gap is formed and the adhesion strength of the molten particles is lowered.

In the present invention, a plasma spraying apparatus is used as a thermal spraying apparatus. Preferably, a thermal spraying apparatus using a metal thermal spray material in the form of a line or a stick is used. Such a thermal spraying apparatus is known as described in Patent References 3 to 5. The known thermal spraying apparatus can be used in the present invention. In the present invention, the above plasma spraying apparatus is used and thermal spraying is performed in such a manner that an average area of each of molten particles of the thermal spray material when the molten particles have stuck to the surface of the thermal spray subject is 10000 to 100000 $\mu m^2$.

In the case of thermal spraying by the plasma spraying apparatus using a metal thermal spray material in the form of a line or a stick, molten particles collide against a surface of a thermal spray subject S and are then deposited on the surface while being flat, as shown in FIG. 1A. Since the molten particles are deposited in a complicated shape, adhesion strength between individual spray coatings m is enhanced and adhesion strength of a spray coating M in totality is also enhanced. Moreover, a temperature of the surface of the thermal spray subject increases and wettability of a droplet with respect to the surface of the thermal spray subject is improved, by performing thermal spraying in such a manner that the average area of each molten particle when the molten particles have stuck to the surface of the thermal spray subject is 10000 to 100000 $\mu m^2$.

Figure 1B:
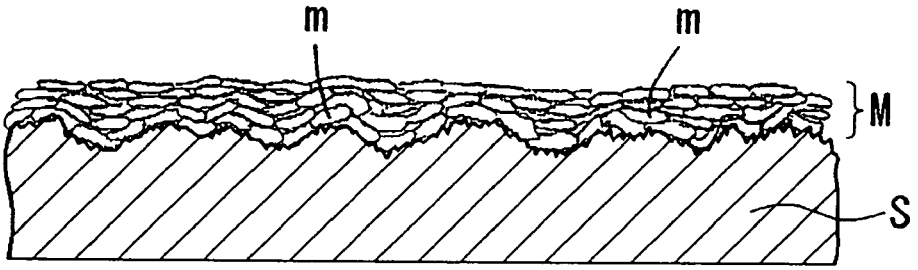
FIG. 1B generally shows a deposition state of a spray coating in the case where thermal spraying is performed by a gas flame spraying apparatus.
Figure 1C:
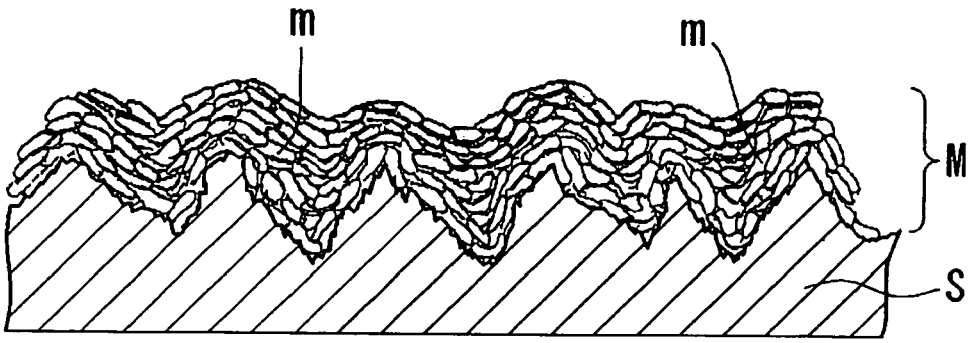
FIG. 1C generally shows a deposition state of a spray coating in the case where thermal spraying is performed by the gas flame spraying apparatus and surface roughness is large.

On the other hand, in the case of thermal spraying by a gas flame spraying apparatus, concave portions of a surface of a thermal spray subject S are filled with initial molten particles, as shown in FIG. 1B. Since the individual spray coatings m are in the form of thin scales, a coated surface is smooth. Thus, adhesion strength between a coating and another coating deposited thereon is lowered and the adhesion strength of the spray coating M in totality is also lowered. Therefore, in the case of thermal spraying by the gas flame spraying apparatus, surface concavities and convexities that have a comparable level of roughness to those obtained by roughening by a blast treatment are required. When the surface roughness is large, the respective spray coatings m in the form of thin scales are formed along a concavo-convex surface of the surface of the thermal spray subject S, as shown in FIG. 1C, and lowering of the adhesion strength between the spray coatings m sequentially deposited is suppressed. Therefore, the adhesion strength of the spray coating M in totality is sufficient.

In the present invention, plasma spraying is performed for the surface of the thermal spray subject that is made to have an average roughness Ra of 2 to 10 μm by a pretreatment. When this thermal spraying is performed under a condition in which the average area of each of the molten particles of the thermal spray material when the molten particles have stuck to the surface of the thermal spray subject is 10000 to 100000 $\mu m^2$, deposition of individual spray coating layers shown in FIG. 1A is obtained and the adhesion strength of the spray coating is high in totality. If the average area of each molten particle is smaller or larger than the above range, a gap is generated between the spray coatings, and the temperature of the surface of the thermal spray subject cannot be sufficiently increased. Thus, sufficient adhesion strength of the spray coating cannot be obtained. The average area of each molten particle in the case of gas flame spraying is several hundreds to several thousands of micro squares. In the spray coating formed by arc spraying, the average area of each molten particle is several hundreds to several thousands of micro squares and molten particles that are slightly larger than those in the case of gas flame spraying are contained. However, when the average roughness Ra of the surface of the thermal spray subject is about 2 to about 10 μm, sufficient adhesion strength of the spray coating cannot be obtained.

There is no condition to be specifically limited other than the roughening process, the surface roughness and the condition of thermal spraying that are described above. A thickness of the spray coating can be selected to be an appropriate thickness in the range of from 50 to 200 μm in accordance with a required anticorrosion performance. As the metal thermal spray material, various metals such as aluminum, zinc, copper, cobalt, titanium and alloys of those metals, that are conventionally known, can be used. In particular, aluminum and aluminum alloys such as an aluminum-magnesium alloy and a zinc-aluminum alloy are more suitable than other metals because a sacrificial anode action is fully achieved. Moreover, a sealing treatment may be performed after formation of the spray coating. Especially in the case of field repair, it is better to perform the sealing treatment after thermal spraying as soon as possible. Resins or organic chemicals that are conventionally known can be used as a sealing material.

EXAMPLE

An example in which the thermal spraying method of the present invention is applied to field repair of a steel structure is described in an order of main processes. In the following description, a case in which an existing steel structure is a structure in which galvanized steel is coated, a coating is locally separated, and a portion in which a zinc coating is corroded is repaired by thermal spraying is described as an example.

[Roughening Process]

Figure 2:
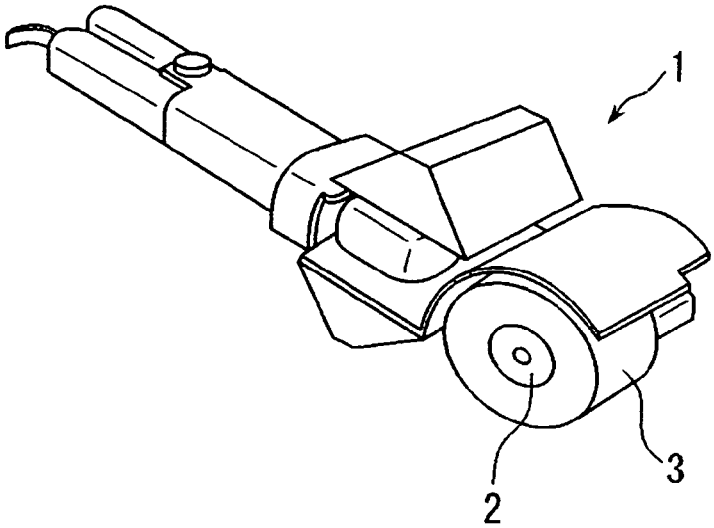
FIG. 2 is a perspective view of an exemplary grinding tool used in an example of the present invention.

FIG. 2 is a perspective view of an exemplary grinding tool used in this example.

The grinding tool 1 is an electric grinding tool called a grinding roller type sander. In the grinding tool 1, sandpaper 3 is attached to a roller 2. A surface of a damaged portion of steel is ground by rotation of the roller 2. Abrasive grains of silicon carbide, alumina, or the like having grain size number of #20 to #40 (average grain size: 1000 to 425 μm) are firmly fixed on the sandpaper 3 with resin binder. When the steel surface is ground by means of the grinding tool 1, the coating and the damaged portion of plating are ground and the steel surface is roughened to have an average roughness Ra of about 5 to about 8 μm. Other than the grinding roller type sander, a belt sander, a disc sander, a flap wheel, a rotary brush, or the like can be used as the grinding tool in an appropriate manner.

[Thermal Spraying Apparatus]

Figure 3:
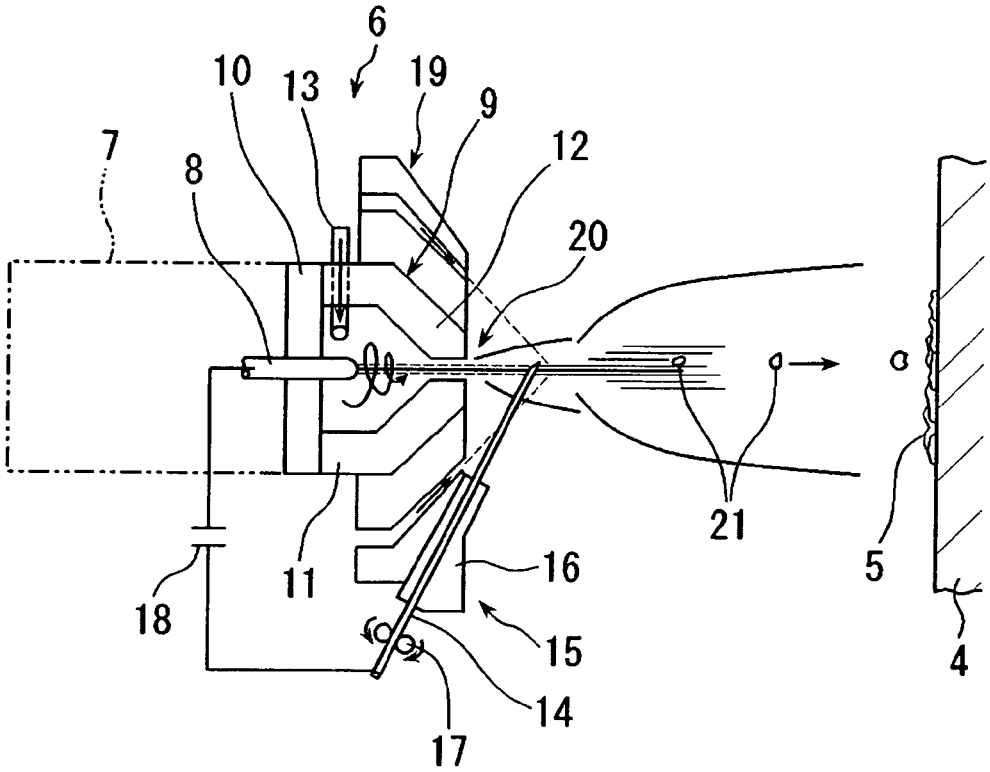
FIG. 3 shows a structure of a main part of a plasma spraying apparatus used in the example that is performing thermal spraying.

FIG. 3 is a diagram showing the structure of a main part of a plasma spraying apparatus used in this example that is performing thermal spraying.

An electrode 8 of a plasma torch (internal structure of a main body is omitted) 7 of the plasma spraying apparatus 6 is provided to project from an insulating rear wall 10 of a nozzle 9 ahead of the nozzle 9. The nozzle 9 includes a cylindrical peripheral wall 11 connected to the rear wall 10 and a conical tapered tube portion 12 provided ahead of the peripheral wall 11. An outline of a cross section of the tapered tube portion 12 rapidly becomes smaller forward. A plurality of inflow ports 13 for allowing plasma gas to flow into the nozzle 9 along a circumferential direction are formed in the peripheral wall 11 at a plurality of positions. As the plasma gas, inert gas such as nitrogen, argon, helium, and the like can be used alone or in combination.

An outer circumferential nozzle 19 that spurts gas along the outer circumferential surface of the nozzle 9 ahead of a center line of the nozzle 9 is provided on the outer circumference of the tapered tube portion 12 of the nozzle 9. As the gas, an air, nitrogen, argon, helium, and the like can be used. In the outside of the outer circumferential nozzle 19, a supply device 15 for sending wire 14 of an Al—Mg alloy as a thermal spray material is provided ahead of the center line of the nozzle 9 and to a base side of a gas-spurting portion. The supply device 15 includes a guide member 16 and a pushing roller 17.

The electrode 8 is connected to a negative pole of a DC power supply device 18 and the wire 14 is connected to a positive pole of the DC power supply device 18. The DC power supply device 18 can supply a DC voltage of about 30 to about 200 V and a DC current of about 50 to about 500 A. Moreover, the DC power supply device 18 can apply a high voltage of approximately 3000 V in a short period of time.

[Thermal Spraying Process]

The plasma spraying apparatus 6 is arranged in such a manner that the center line of the nozzle 9 of the plasma spraying apparatus 6 is perpendicular to a surface of steel 4 that is a thermal spray subject.

When the plasma gas is made to flow through the inflow ports 13 of the plasma spraying apparatus 6, the plasma gas generates a swirling flow along the peripheral wall 11. In this state, when a voltage of 3000 V is applied by means of the DC power supply device 18, spark discharge occurs between the electrode 8 and the wire 14. Since the plasma gas is swirling and a pressure around a center of the plasma gas is lowered, the plasma gas around the center is preferentially discharged in the spark discharge. When the spark discharge occurs, the plasma gas between the electrode 8 and the wire 14 is ionized, that is, is put in an ionization state. Thus, a DC current starts to flow. The flow of the DC current in the plasma gas promotes generation of plasma from the gas, so that a plasma arc flow is formed. The plasma arc flow flows along the central portion of the plasma gas in which a pressure is reduced because of the swirling flow. The plasma gas is heated by that plasma arc flow and bursts from an outlet 20 of the nozzle 9 as plasma flame.

A top end of the wire 14 is rapidly heated and melted by the plasma arc flow. The molten wire 14 is turned into molten particles 21 that are blown away by the plasma flame toward the steel 4. Since inert gas is used as the plasma gas, the amount of oxygen that is in contact with the molten particles 21 is small and oxidation of the spray coating 5 that is formed can be prevented. Moreover, the wire 14 in which the top end is molten and lost is moved ahead by the pushing roller 17, so that a tip of the wire 14 corresponds with the center line of the nozzle 9. The outer circumferential nozzle 19 makes compressed gas flow from its rear part and spurts out the gas from its front part in a conical manner. When the gas is blown to the molten particles 21 from the outer circumference side, the molten particles 21 are made fine so as to have a size appropriate for formation of the spray coating 5. The fine molten particles 21 then collide against the surface of the steel 4 and become flat. A number of molten particles 21 described above are deposited and bonded to each other, thereby forming the spray coating 5 by being cooled.

[Measurement Result of Adhesion Strength]

In order to confirm an effect of the thermal spraying method of the present invention, for each of the case where a surface of a thermal spray subject was roughened by a blast treatment and the case where the surface was roughened by grinding, thermal spraying was performed by a known gas flame spraying apparatus and the plasma spraying apparatus shown in FIG. 3, and surface roughness after roughening and adhesion strength of spray coating were measured. Table 1 shows the measurement results. Please note that practically sufficient adhesion strength is defined to be 4.5 N/mm$^2$ or more in the description of ISO (International organization for standardization) 2063. This example employed that value as a necessary value of the adhesion strength. [Table 1]

TABLE 1

| Thermal spraying method | Roughening | Surface roughness Ra after roughening (μm) | Adhesion strength of spray coating (N/mm$^2$) |
|---|---|---|---|
| Gas flame spraying | Blast treatment | 20 | 6 to 7 |
| | Grinding | 10 | 3 to 4 |
| | | 2 | 1 to 2 |

TABLE 1-continued

| Thermal spraying method | Roughening | Surface roughness Ra after roughening (μm) | Adhesion strength of spray coating ($N/mm^2$) |
|---|---|---|---|
| Plasma spraying | Blast treatment | 20 | 7 or more |
| | Grinding | 10 | 6 to 7 |
| | | 2 | 6 to 7 |
| | | 1 | 2 to 3 |

Note)
The adhesion strength was measured by means of Elcometer conforming to JIS H8661.

As is seen from Table 1, in the case of gas flame spraying, the adhesion strength of spray coating was about 6 to 7 $N/mm^2$ when a blast treatment was performed as roughening and the surface roughness Ra was about 20 μm. That is, sufficient adhesion strength was obtained. However, when grinding was performed and the surface roughness Ra was smaller than 15 μm, the adhesion strength of spray coating was 4 $N/mm^2$ or less and practically sufficient adhesion strength was not obtained. The surface roughness Ra obtained by the blast treatment is usually about 15 to about 40 μm and the adhesion strength obtained by gas flame spraying is about 6 to 7 $N/mm^2$. On the other hand, in the case of plasma spraying, the adhesion strength of spray coating was 6 to 7 $N/mm^2$ even when surface roughness Ra obtained by grinding was in a range from 2 to 10 μm. That is, the sufficient adhesion strength was obtained. However, when the surface roughness Ra was smaller than 2 μm, the adhesion strength was low. Thus, such small surface roughness Ra was not practically preferable.

INDUSTRIAL APPLICABILITY

The thermal spraying method of the present invention is described above, with reference to a steel structure as an example. The thermal spraying method of the present invention can be applied to corrosion prevention of various metal structures including a steel structure and its material. Moreover, the thermal spraying method of the present invention can be applied to a structure formed from a material other than a metal body and the material by appropriately selecting a metal thermal spray material and a condition of thermal spraying.

The invention claimed is:

1. A plasma spraying method of spraying a metal thermal spray material onto a metal body to form a spray coating for corrosion prevention, said plasma spraying method comprising:

roughening a surface of the metal body by using a grinding tool to achieve an average roughness Ra of the surface in a range of 2 μm to 10 μm; and performing plasma spraying in a manner such that an average area covered by each molten particle of the metal thermal spray material when the molten particles have stuck to the surface of the metal body is 10000 $\mu m^2$ to 100000 $\mu m^2$ to thereby form the spray coating.

2. The plasma spraying method according to claim 1, wherein said performing plasma spraying comprises using a plasma spraying apparatus which uses the metal thermal spray material in the form of a wire.

3. The plasma spraying method according to claim 2, further comprising performing a sealing treatment on the spray coating after said performing plasma spraying.

4. The plasma spraying method according to claim 2, wherein the metal thermal spray material is aluminum or an aluminum alloy.

5. The plasma spraying method according to claim 4, further comprising performing a sealing treatment on the spray coating after said performing plasma spraying.

6. The plasma spraying method according to claim 1, wherein the metal thermal spray material is aluminum or an aluminum alloy.

7. The plasma spraying method according to claim 6, further comprising performing a sealing treatment on the spray coating after said performing plasma spraying.

8. The plasma spraying method according to claim 6, wherein the metal thermal spray material is an aluminum alloy comprising an aluminum-magnesium alloy or a zinc-aluminum alloy.

9. The plasma spraying method according to claim 1, further comprising performing a sealing treatment on the spray coating after said performing plasma spraying.

10. The plasma spraying method according to claim 1, wherein said roughening the surface of the metal body comprises using a grinding tool to form linear marks on the surface of the metal body, the linear marks crossing at an angle of intersection in a range of 60 degrees to 90 degrees.

* * * * *